US011712122B2

(12) United States Patent
Hoffstetter

(10) Patent No.: US 11,712,122 B2
(45) Date of Patent: Aug. 1, 2023

(54) PICTURE HANGING SYSTEM

(71) Applicant: Gregory Jordan Hoffstetter, St. Petersburg, FL (US)

(72) Inventor: Gregory Jordan Hoffstetter, St. Petersburg, FL (US)

( * ) Notice: Subject to any disclaimer, the term of this patent is extended or adjusted under 35 U.S.C. 154(b) by 0 days.

(21) Appl. No.: 17/410,248

(22) Filed: Aug. 24, 2021

(65) Prior Publication Data

US 2023/0064453 A1 Mar. 2, 2023

(51) Int. Cl.
*A47G 1/20* (2006.01)
*A47G 1/16* (2006.01)

(52) U.S. Cl.
CPC ..... *A47G 1/20* (2013.01); *A47G 1/162* (2013.01)

(58) Field of Classification Search
CPC ..... A47G 1/20; A47G 1/162
USPC ..... 248/493
See application file for complete search history.

(56) References Cited

U.S. PATENT DOCUMENTS 1,792,326 A * 2/1931 Samard ..... A47G 1/1666 24/132 R
2,049,716 A * 8/1936 Owen ..... A47G 1/20 248/549
3,020,013 A * 2/1962 Ochin ..... A47G 1/20 248/306
3,923,278 A * 12/1975 Marcil ..... A47G 1/20 248/304
4,146,204 A * 3/1979 Thalenfeld ..... A47F 5/0807 248/294.1
4,571,866 A * 2/1986 Cole ..... A47G 1/162 248/496
5,178,355 A * 1/1993 Herzig ..... A47G 1/20 248/489
2004/0195477 A1* 10/2004 Rivellino ..... A47G 1/20 248/216.4

FOREIGN PATENT DOCUMENTS

FR 446962 A * 12/1912
FR 2676344 A1 * 11/1992 ..... A47G 1/20
GB 179046 A * 5/1922
GB 406150 A * 2/1934

OTHER PUBLICATIONS

Hoffstetter, Gregory Jordan, Office Action from the USPTO dated Jan. 4, 2016, U.S. Appl. No. 14/153,162 (Unpublished).

* cited by examiner

*Primary Examiner* — Kimberly T Wood
(74) *Attorney, Agent, or Firm* — GrayRobinson, P.A.; Michael J. Colitz, III

(57) ABSTRACT

A base plate has a generally rectangular central section, a trapezoidal lower section, a generally rectangular upper section, and similarly configured generally semi-circular side sections. Vertical bends are between the side sections and the central section whereby the side sections extend forwardly to form an angle of 90 degrees with respect to the central section. Each side section has a pivot hole and a horizontal bend between the upper section and the central section. A support wire is shaped to form central, lower and upper regions. The central region has converging legs. The lower region has an upwardly extending J-shaped hook. The upper region has outwardly extending coaxial pivot fingers received in the pivot holes.

7 Claims, 4 Drawing Sheets

PICTURE HANGING SYSTEM

TECHNICAL FIELD

The present invention relates to a picture hanger system and more particularly pertains to mounting a picture on a wall and for facilitating the locating of a picture strand during mounting, the mounting and the locating being done in a safe, convenient and economical manner.

BACKGROUND OF THE INVENTION

The use of picture hanger systems of known designs and configurations is known in the prior art. More specifically, picture hanger systems of known designs and configurations previously devised and utilized for the purpose of mounting a picture on the wall are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a picture hanger system that allows for mounting a picture on a wall and for facilitating the locating of a picture strand during mounting, the mounting and the locating being done in a safe, convenient and economical manner.

In this respect, the picture hanger system according to the present invention substantially departs from the conventional concepts and designs of the prior art, and in doing so provides an apparatus primarily developed for the purpose of mounting a picture on a wall and facilitating the locating a picture strand during mounting.

Therefore, it can be appreciated that there exists a continuing need for a new and improved picture hanger system which can be used for mounting a picture on a wall and for facilitating the locating of a picture strand during mounting, the mounting and the locating being done in a safe, convenient and economical manner. In this regard, the present invention substantially fulfills this need.

SUMMARY OF THE INVENTION

In view of the foregoing disadvantages inherent in the known types of picture hanger systems of known designs and configurations now present in the prior art, the present invention provides an improved picture hanger system. As such, the general purpose of the present invention, which will be described subsequently in greater detail, is to provide a new and improved picture hanger system and method which has all the advantages of the prior art and none of the disadvantages.

To attain this, the present invention essentially comprises a base plate having a generally rectangular central section, a trapezoidal lower section, a generally rectangular upper section, and similarly configured generally semi-circular side sections. Vertical bends are between the side sections and the central section whereby the side sections extend forwardly to form an angle of 90 degrees with respect to the central section. Each side section has a pivot hole and a horizontal bend between the upper section and the central section. A support wire is shaped to form central, lower and upper regions. The central region has converging legs. The lower region has an upwardly extending J-shaped hook. The upper region has outwardly extending coaxial pivot fingers received in the pivot holes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved picture hanger system which has all of the advantages of the prior art picture hanger systems of known designs and configurations and none of the disadvantages.

It is another object of the present invention to provide a new and improved picture hanger system which may be easily and efficiently manufactured and marketed.

It is further object of the present invention to provide a new and improved picture hanger system which is of durable and reliable constructions.

An even further object of the present invention is to provide a new and improved picture hanger system which is susceptible of a low cost of manufacture with regard to both materials and labor, and which accordingly is then susceptible of low prices of sale to the consuming public, thereby making such picture hanger system economically available to the buying public.

Lastly, it is an object of the present invention to provide a new and improved picture hanging system for mounting a picture on a wall and for facilitating the locating of a picture strand during mounting, the mounting and the locating being done in a safe, convenient and economical manner.

These together with other objects of the invention, along with the various features of novelty which characterize the invention, are pointed out with specificity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

DETAILED DESCRIPTION OF THE DRAWINGS

Figure 1:
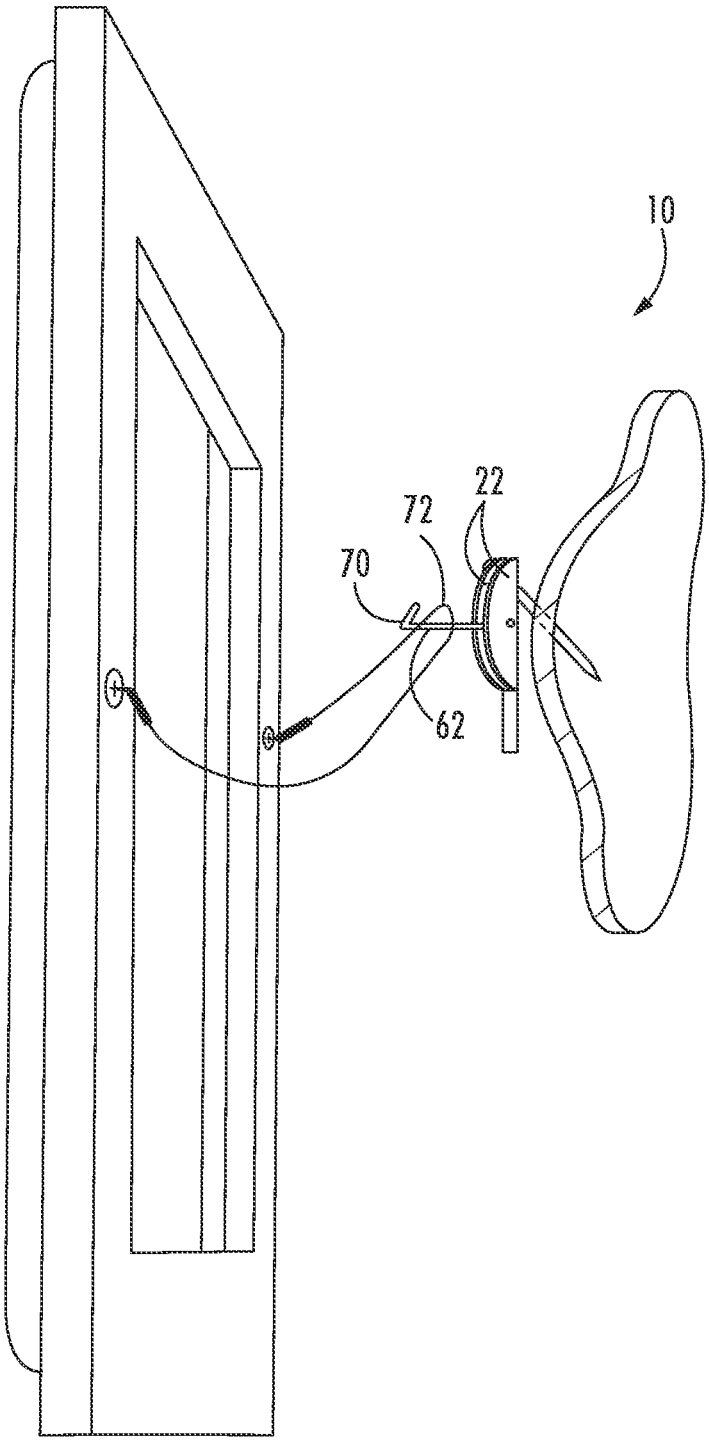
FIG. 1 is a perspective illustration of a picture hanging system constructed in accordance with the principles of the present invention.
Figure 2:
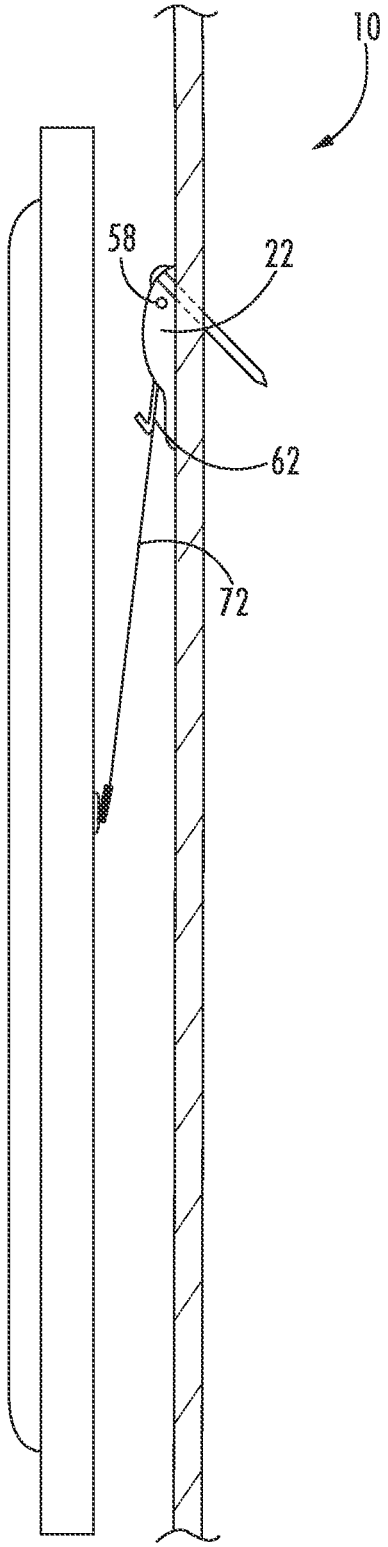
FIG. 2 is a side elevational view of the system illustrated in FIG. 1.
Figure 3:
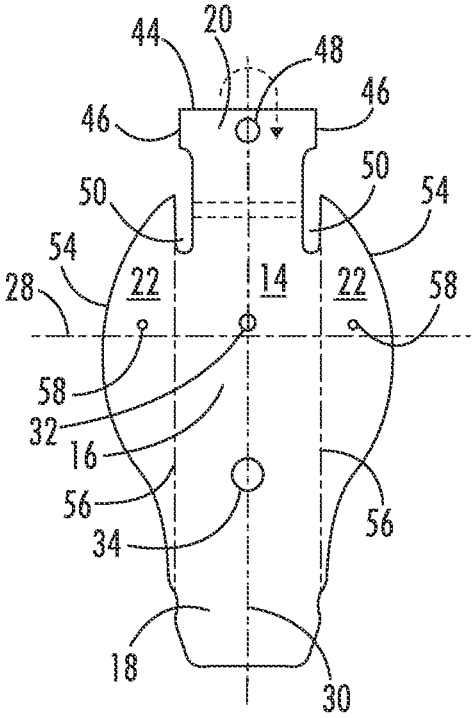
FIGS. 3 and 4 are front elevational views of components of the system at various stages of construction.
Figure 4:
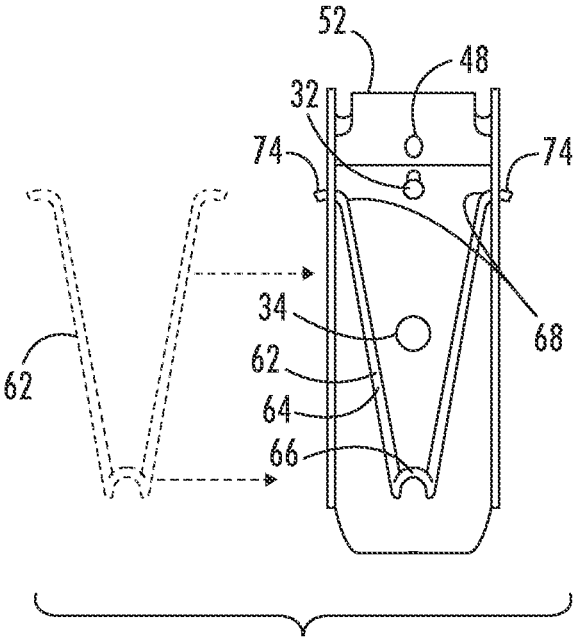
Figure 8:
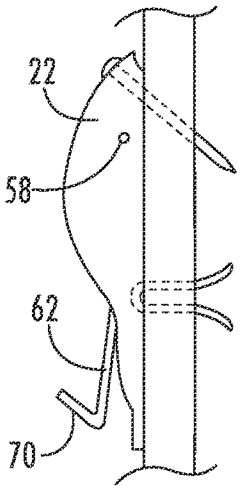
FIG. 8 is a side elevational view similar to FIG. 7 but in a deployed orientation nailed to a wall.
Figure 7:
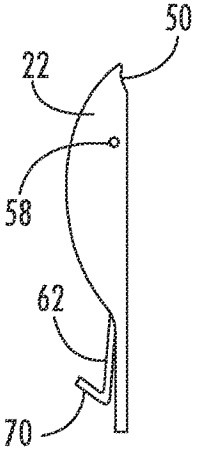
FIG. 7 is a side elevational view taken along line 7-7 of FIG. 5.
Figure 6:
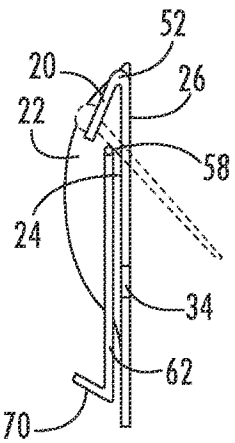
FIG. 6 is a cross sectional view taken along line 6-6 of FIG. 5.
Figure 5:
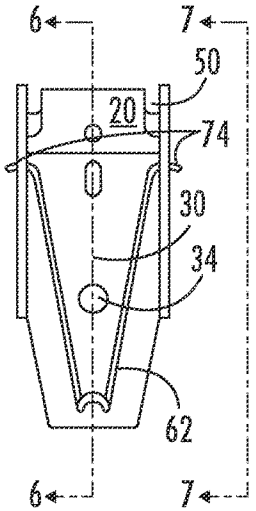
FIG. 5 is a front elevational view with the components fully assembled ready for use.

With reference now to the drawings, and in particular to FIG. 1 thereof, the preferred embodiment of the new and improved picture hanging system embodying the principles and concepts of the present invention and generally designated by the reference numeral 10 is described.

The picture hanger system 10 is comprised of a plurality of components. Such components in their broadest context include a base plate and a support wire. Such components are individually configured and correlated with respect to each other so as to attain the desired objective.

The picture hanger system 10 is for mounting a picture on a wall and for facilitating the location of a picture strand during mounting, the mounting and the locating being done in a safe, convenient and economical manner. First provided is a base plate 14 having a central section 16, a lower section 18, an upper section 20, and similarly configured side sections 22. The base plate has a forward face 24 and a rearward face 26. The base plate is vertically oriented over the majority of its extent during use. The base plate is fabricated of a single stamped piece of sheet metal. The base plate, prior to bending, has a maximum width at the side sections of 1.5 inches, a maximum height of 2.5 inches, and a thickness of 0.050 inches.

The central section of the base plate has a generally rectangular configuration with a top and a bottom separated by a height of 1.50 inches. The central section has sides separated by a width of 0.75 inches. The central section is vertically oriented during use. The central section has a vertical centerline 30 and a horizontal centerline 28. A small nail hole 32 is formed in the central section on the vertical centerline above the horizontal centerline. A large screw hole 34 is formed in the central section on the vertical centerline above the bottom of the central section.

The lower section has a generally trapezoidal configuration with a top. The lower section has a bottom edge 40 separated from the top by a height of 0.75 inches. The lower section has converging sides separated by a width of 0.50 inches at the bottom edge. The lower section is vertically oriented during use. The lower section has a vertical centerline coextensive with the vertical centerline of the central section.

The upper section has a generally rectangular configuration with a bottom. The upper section has a top edge 44 separated from the bottom by a height of 0.75 inches. The upper section has parallel side edges 46 separated by a width of 0.50 inches adjacent to the top edge. The upper section has a vertical centerline coextensive with the vertical centerline of the central section. The upper section has a small nail hole 48 on the vertical centerline adjacent to the top edge. A narrow recess 50 along each side edge of the upper section extends into the central section. An upper bend 52 is between the upper section and the central section whereby the upper section extends forwardly to form an angle of from 15 degrees to 60 degrees with respect to the central section.

Each side section has a generally semi-circular configuration with an interior. Each side section has an exterior edge 54 separated from the interior by a maximum width of 1.5 inches and a maximum height of 1.5 inches. The side sections have a horizontal centerline coextensive with the horizontal centerline of the central section. Central bends 56 are between the side sections and the central section whereby the side sections extend forwardly to form an angle of 90 degrees with respect to the central section. Each side section has a pivot hole 58 on the horizontal centerline adjacent to the interiors of the side sections. The pivot holes are in axial alignment and are spaced apart by 0.75 inches after the forming of the bends in the side sections.

A support wire 62 is next provided. The support wire is shaped to form a central region 64, a lower region 66, and an upper region 68. The central region has converging legs with widely spaced interior ends and narrowly spaced exterior ends. The lower region has an upwardly extending J-shaped hook 70 for receiving the support strand 72 of the picture to be hanged. The support strand may be a wire or a string or a cord or the like. The upper region has outwardly extending coaxial pivot fingers 74 received in the pivot holes. The pivot fingers 74 and the small nail hole 32 are substantially elevationally co-planar. This preferred arrangement sets the pivot point for the pivot fingers in the same general plane as the nail entering the wall to thereby abate the creation of a lever force which would tend to pull the nail from the wall.

The support wire is fabricated of 0.090 inch spring steel. The support wire has a raised orientation prior to use which is generally perpendicular to the central section to facilitate locating the J-shaped hook when hanging the picture. The support wire has a lowered orientation during use which is generally parallel with the central section to facilitate supporting the picture while hanging. The weight of the picture being hung through the strand acts to lower the J-shaped hook. The support wire during use is out of contact with the wall upon which it is attached due to the lower section of the base plate. The J-shaped hook is located at an elevation above the bottom edge of the base plate.

Figure 10:
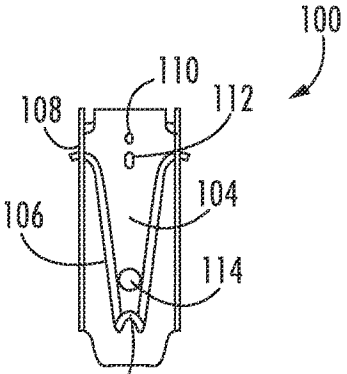
Figure 9:
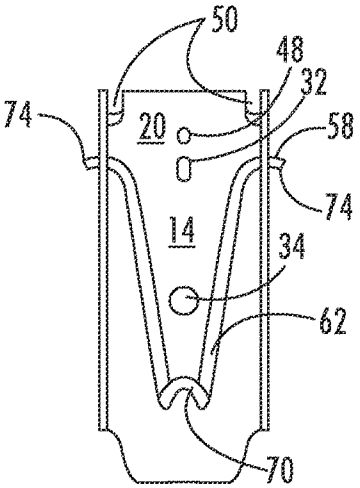
Figure 15:
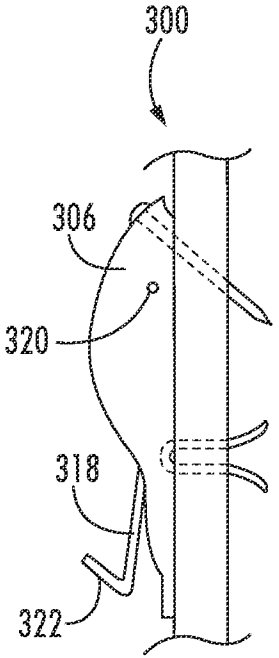
FIGS. 12-15 illustrate an alternative embodiment utilizing a plastic, molded base plate.
Figure 14:
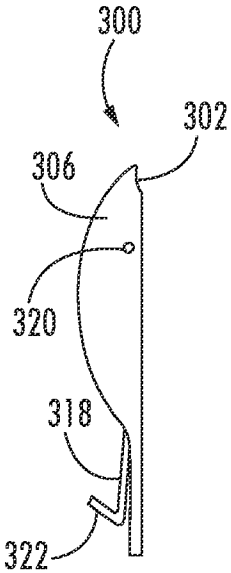
Figure 13:
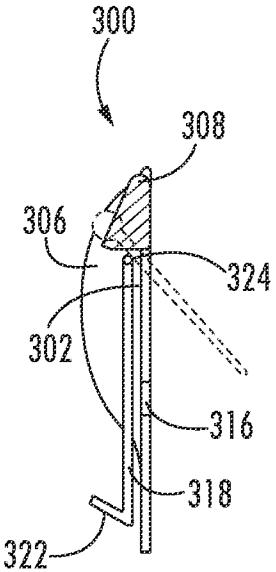
Figure 12:
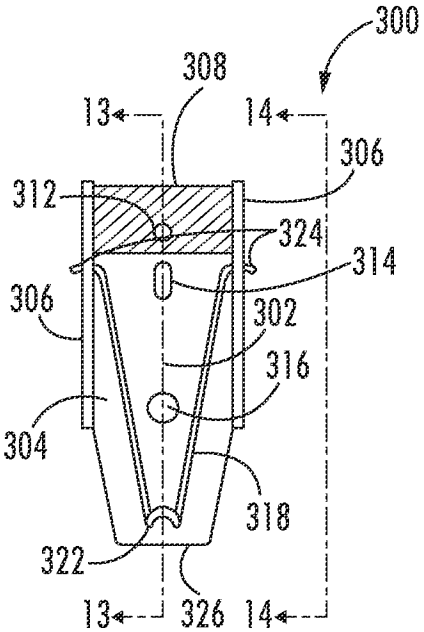

An alternate embodiment of the system 100 is shown in FIG. 10. In this embodiment, the base plate 104 and support wire 106 are of an intermediate size with holes 108, 110, 112, 114. In this embodiment, after forming the horizontal and vertical bends, the base plate has a width of from 40 percent and 45 percent of the height of the base plate.

Figure 11:
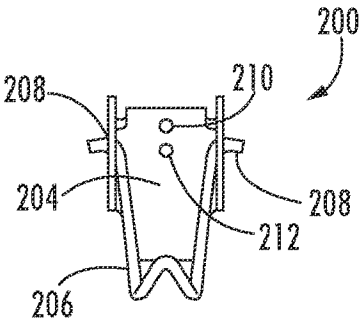
FIGS. 9, 10 and 11 are front elevational views of the primary and alternate embodiments of the invention.

Another alternate embodiment of the system 200 is shown in FIG. 11. In this embodiment, the base plate 204 and support wire 206 are of a reduced size with holes 208, 210, 212 of a reduced size. In this embodiment, the base plate, after forming the horizontal and vertical bends, has a width of from 55 percent and 65 percent of the height of the base plate. The J-shaped hook is located at an elevation above the bottom edge of the base plate.

Still yet another embodiment of the present invention is illustrated in FIGS. 12-15. The system 300 depicted in these figures is the same in many respects to the primary embodiment illustrated in FIGS. 1-9. However, in this embodiment, base plate 302 is entirely formed from a molded plastic and not a pressed metal. Plastic base plate 302 is defined by a central section 304 and opposing side sections 306. As in the primary embodiment, side sections 306 are formed at a 90 degree angle with respect to the base plate 302 and included rounded outer edges. This is preferably accomplished via a plastic mold.

In an important aspect of this alternative embodiment, the upper bent edge 52 of the primary embodiment is replaced by a triangular shaped and solid piece of molded plastic 308. This triangular head 308 has an outer surface that is angled at between 15 degrees to 60 degrees from the horizontal back wall of central section 304. Triangular head 308 is molded integrally with base plate 302. Triangular plastic head 308 includes a nail hold 312 for allowing passage of the nail that secures system 300 to a wall. Smaller and larger holes (314 and 316) are also included for securing 300 to the wall as noted above and depicted in FIG. 15. The triangular head 308 is molded to avoid the gaps on either side of bend 52 in the primary embodiment.

Pivot wire 318 is pivotally secured to the base plate 302. This is accomplished by pivotally securing the opposing ends of pivot wire 318 within pivot holes 320 formed within the side sections 306. The ends of pivot wire are general parallel to one another. The pivot wire terminates in a J-hook 322. System 300 has the advantage of being lighter weight, easier to manufacture, and less expensive. The upper extent of system 300 is formed from a solid plastic molded piece 308. This solid piece prevents the nail from cracking or otherwise damaging the plastic. The piece 308 also acts as an anchor for the adjacently mounted J-hook 322. Other than the J-hook 322, all components of system 300 are formed from a hardened and molded plastic.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A picture hanger system comprising:

a molded, plastic base plate having a generally rectangular central section, a lower section with inwardly angled edges, a generally rectangular upper section and similarly configured generally semi-circular side sections, vertical bends between the side sections and the central section whereby the side sections extend forwardly to form an angle of 90 degrees with respect to the central section, each side section having a pivot hole, the side sections having lower ends that terminate at the lower section;

a molded triangular head formed at an upper end of the base plate, the triangular head being molded so that there are no gaps between the triangular head and the side sections, a nail hole formed within the triangular head; and a support wire shaped to form central, lower and upper regions, the central region having converging legs, the lower region having an upwardly extending J-shaped hook, the upper region having outwardly extending coaxial pivot fingers received in the pivot holes.

2. The system as set forth in claim 1 and wherein the triangular head and base plate are integral.

3. The system as set forth in claim 2 and further including a screw holes in the central section.

4. The system (100) as set forth in claim 1 wherein the portion of the base plate between side sections has a width of between 40 percent to 45 percent of the height of the base plate.

5. The system (10) as set forth in claim 1 wherein the portion of the base plate between the side sections has a width of between 25 percent to 35 percent of the height of the base plate.

6. The system (200) as set forth in claim 1 wherein:

the base plate (204) and support wire (206) are of a reduced size with holes (208)(210)(212) of a reduced size; and the base plate, after forming the horizontal and vertical bends, has a width of from 55 percent and 65 percent of the height of the base plate, the J-shaped hook being located at an elevation below the base plate.

7. A picture hanger system for mounting a picture on a wall and for facilitating the locating a picture strand during mounting, the mounting and the locating being done in a safe, convenient and economical manner, the system comprising, in combination:

a plastic base plate having a central section, a lower section, an upper section and similarly configured side sections, the base plate having a forward face and a rearward face, the base plate being vertically oriented during use;

the central section having a generally rectangular configuration with a top and a bottom separated by a height of 1.50 inches, the central section having sides separated by a width of 0.75 inches, the central section being vertically oriented during use, the central section having a vertical centerline and a horizontal centerline, a small nail hole formed in the central section on the vertical centerline above the horizontal centerline, a large screw hole formed in the central section on the vertical centerline above the bottom of the central section;

the lower section having inwardly angled side edges and a top, the lower section having a bottom edge separated from the top by a height of 0.75 inches, the inwardly angled sides edges are separated by a width of 0.50 inches at the bottom edge, the lower section being vertically oriented during use, the lower section having a vertical centerline coextensive with the vertical centerline of the central section;

the upper section having a generally rectangular configuration with a bottom, the upper section having a top edge separated from the bottom by a height of 0.75 inches, the upper section having parallel side edges separated by a width of 0.50 inches adjacent to the top edge, the upper section having a vertical centerline coextensive with the vertical centerline of the central section, the upper section having a small nail hole on the vertical centerline adjacent to the top edge, an upper triangular head formed at the upper section, an outer face of the triangular head extending forwardly to form an angle of from 15 degrees to 60 degrees with respect to the central section, the triangular head being molded to the side sections such that there are no gaps between the head and the side sections;

each side section having a generally semi-circular configuration with an interior, the side sections each having an exterior edge separated from the interior by a maximum width of 1.5 inches and a maximum height of 1.5 inches, the side sections having a horizontal centerline coextensive with the horizontal centerline of the central section, each side section having a pivot hole on the horizontal centerline adjacent to the interiors of the side sections, the pivot holes being in axial alignment and spaced apart by 0.75 inches after the forming of the bends in the side sections, the side sections having lower edges that terminate at the lower section;

a support wire, the support wire being shaped to form a central region and a lower region and an upper region, the central region having converging legs with widely spaced interior ends and narrowly spaced exterior ends, the lower region having an upwardly extending J-shaped hook for receiving the support strand of the picture to be hanged, the J-shaped hook being located at an elevation above the bottom edge of the base plate, axial pivot fingers received in the pivot holes, the fingers and the small nail hole being substantially elevationally co-planar, the support wire being fabricated of 0.090 inch spring steel, the support wire having a raised orientation prior to use generally perpendicular to the central section to facilitate locating the J-shaped hook when hanging picture, the support wire having a lowered orientation during use generally parallel with the central section to facilitate supporting the picture while hanging, the support wire during use being out of contact with the wall upon which the support wire is attached due to the lower section of the base plate.

* * * * *